US005738242A

United States Patent [19]

Paris

[11] Patent Number: 5,738,242

[45] Date of Patent: Apr. 14, 1998

[54] CONTAINER-MOUNTED IMPLEMENT HOLDER APPARATUS

[76] Inventor: Shane L. Paris, 27 Starsdale Cir., Greenville, S.C. 29609

[21] Appl. No.: 717,685

[22] Filed: Sep. 23, 1996

[51] Int. Cl.[6] ..... B65D 65/00

[52] U.S. Cl. ..... 220/735

[58] Field of Search ..... 220/735, 736, 220/695, 696, 697, 699, 700

[56] References Cited

U.S. PATENT DOCUMENTS

| | | | |
|---|---|---|---|
| 12,876 | 5/1855 | Stimpson | 220/735 |
| D. 264,182 | 5/1982 | Kemp et al. . | |
| D. 333,065 | 2/1993 | Murphy . | |
| D. 361,265 | 8/1995 | Doxey . | |
| 376,001 | 1/1888 | Johnson | 220/735 |
| 454,173 | 6/1891 | MacMeikan | 220/735 |
| 700,653 | 5/1902 | Jobson | 220/735 |
| 1,125,585 | 1/1915 | Menger | 220/735 |
| 1,853,852 | 4/1932 | Estes | 220/735 |
| 2,353,582 | 7/1944 | Pearson | 220/735 |
| 2,864,510 | 12/1958 | Sture | 220/735 |
| 3,931,668 | 1/1976 | Hombach . | |
| 4,121,798 | 10/1978 | Schumacher et al. . | |
| 4,125,210 | 11/1978 | Embree | 220/736 |
| 5,127,616 | 7/1992 | Carney . | |
| 5,415,309 | 5/1995 | Wang | 220/735 |

*Primary Examiner*—Joseph M. Moy

[57] ABSTRACT

An implement holder apparatus is used with a container which has a top rim that has an outer rim diameter which has an exterior rim surface. The implement holder apparatus includes a base portion which has an inner base diameter which is greater than an outer rim diameter of a top rim of a container. The base portion has a open area which permits access to an interior of the container. A first implement retainer portion is connected to a top side of the base portion. In addition, a second implement retainer portion is connected to the top side of the base portion. The first implement retainer portion and the second implement retainer portion are on opposite locations on the base portion. The base portion can be in a form of a ring, and the first implement retainer portion and the second implement retainer portion are located diametrically across from each other on the ring. The base portion includes a threaded interior surface. Alternatively, the base portion can include a first base subassembly, a second base subassembly adjustably connected to the first base subassembly, and a lock assembly for locking the first base subassembly and the second base subassembly in a selected adjustment connection. The first base subassembly and the second base subassembly are adjustable with respect to each other for adjusting the inner base diameter to fit onto a variety of container sizes.

4 Claims, 4 Drawing Sheets

FIG 5
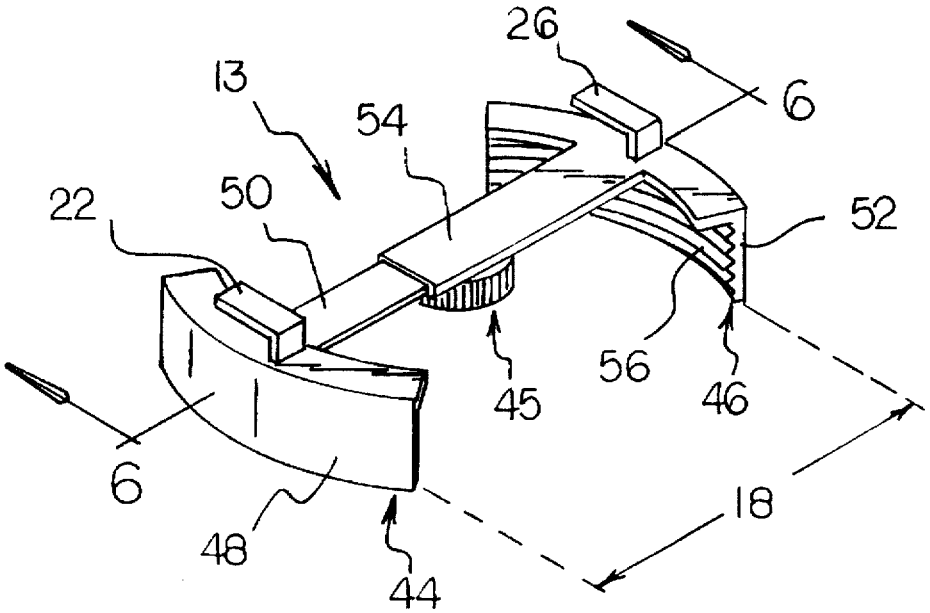
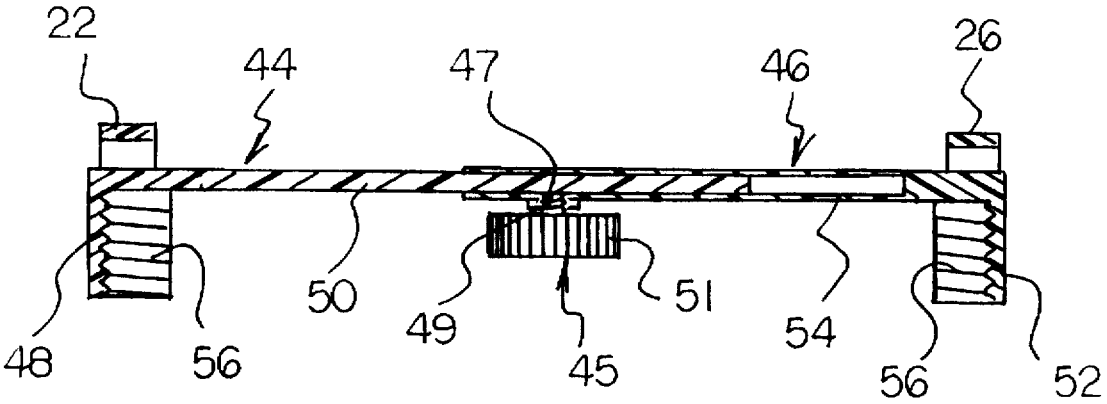
FIG 6

FIG 7
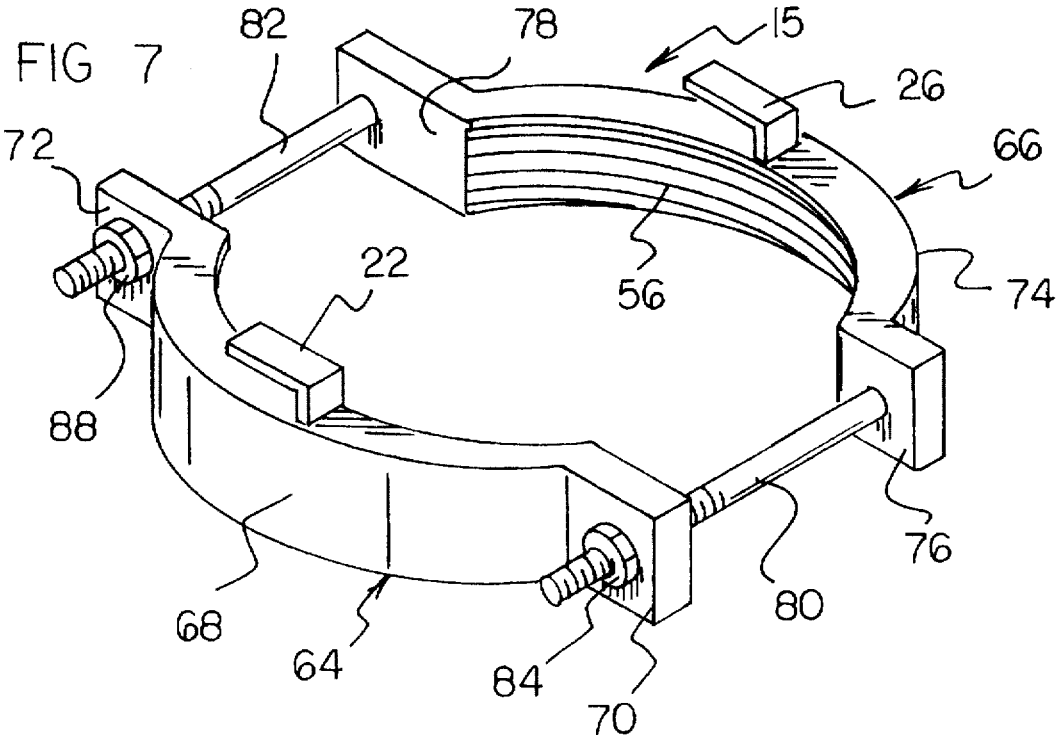
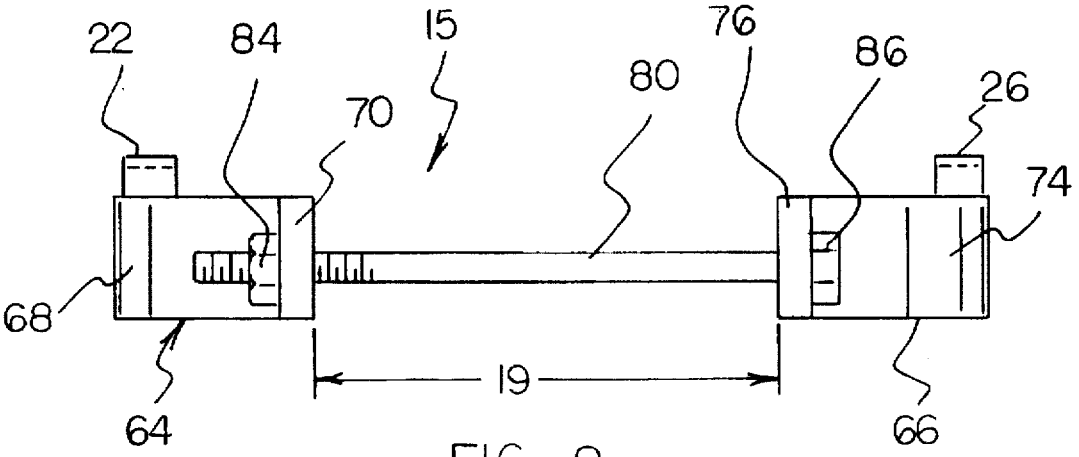
FIG 8

CONTAINER-MOUNTED IMPLEMENT HOLDER APPARATUS

BACKGROUND OF THE INVENTION

1. Field of the Invention

The present invention relates generally to open top containers and, more particularly, to devices especially adapted for retaining implements used with such containers.

2. Description of the Prior Art

Implements are often used to dispense materials from open top containers. For example, implements such as knives, forks, and spoons are often used to dispense food products such as mayonnaise, mustard, peanut butter, honey, jelly, pickles, etc. from jars whose top lids are removed in order to dispense the food product. More specifically, at a party, picnic, family meal, or other occasion when more than one person will use a food containing jar in succession, the jar is often left open, and a common serving utensil is employed for dispensing the food product from the open jar. Once a person if finished using the common serving utensil, such as a knife, the person often lays the knife across the top of the jar. However, because food products are often slippery materials, the knife often slides off of the top of the jar and fails on a table or a floor, thereby creating a mess. In this respect, it would be desirable if a device were provided which prevents a dispensing implement from sliding off of the top of an open container.

Sometimes, the dispensing implement is left in the container when the dispensing implement is not in use. When this is done, a portion of the material in the container often gets on the handle of the dispensing implement, and, as a result, when a person grasps the handle to use the dispensing implement, the person's hand often gets messy from material on the handle. In this respect, it would be desirable if a device were provided which prevents a handle of a dispensing implement from contacting material contained within a container.

Throughout the years, a number of innovations have been developed relating to holders for dispensing implements and utensils, and the following are representative of some of those innovations: U.S. Pat. Nos. 3,931,668, 4,121,798, and 5,127,616. More specifically, each of U. S. Pat. Nos. 3,931,668 and 4,121,798 discloses a holder for a kitchen utensil or the like which clips onto the open top rim of a dispensing container, such as a jar. With each such clip, one jaw portion of the clip is external to the container, and one jaw portion of the clip is internal to the container. As a result, the internal jaw portion can contaminate the contents of the container. To avoid such potential contamination, it would be desirable if a utensil holder were provided for an open top container that does not employ a jaw portion that is internal to the container.

U.S. Pat. No. 5,127,616 discloses a pot lid and utensil holder which is self-supporting and is not supported by a container. Such a lid and utensil holder takes up additional table space beside the container itself. This may especially disadvantageous if there are a number of dispensing containers that employ an equal number of separate, self-supporting utensil holders, whereby a considerable amount of table space is occupied by the utensil holders. In this respect, it would be desirable if a device were provided which holds a dispensing implement for a container and does not take up table space in doing so. As a matter of interest, Des. 264,182, Des. 333,065, and Des. 361,265 disclose designs for lids of dispensing containers.

Still other features would be desirable in an implement holder for a dispensing container. For example, dispensing containers often have screw tops. As a result, the exterior surface of the dispensing container adjacent to the top rim is threaded. In this respect, it would be desirable if a device were provided for retaining a dispensing implement which screws onto exterior threads at the top of a dispensing container.

Dispensing containers such as jars exist in many sizes. Similarly, the outer diameters of the tops of jars come in many sizes. In this respect, it would be desirable if a set of implement holders were provided to fit onto a variety of sizes of the tops of jars. As an alterative to providing a set of implement holders, it would be desirable if a single implement holder were adjustable to fit onto a variety of sizes of the tops of jars.

In cleaning food serving and dispensing articles, dishwashing machines are often employed. In this respect, it would be desirable if a dispensing implement holder were provided that is safe for use in a dishwashing machine.

Thus, while the foregoing body of prior art indicates it to be well known to use implement holders for dispensing containers, the prior art described above does not teach or suggest a container-mounted implement holder apparatus which has the following combination of desirable features: (1) prevents a dispensing implement from sliding off of the top of an open container; (2) prevents a handle of a dispensing implement from contacting material contained within a container; (3) does not employ a jaw portion that is internal to the container; (4) holds a dispensing implement for a container and does not take up table space in doing so; (5) screws onto exterior threads at the top of a dispensing container; (6) can be provided as a set of implement holders wherein each member of the set fits onto one size of a variety of sizes of jar tops; (7) can be provided as a single implement holder which is adjustable to fit onto a variety of sizes of jar tops; and (8) is safe for use in a dishwashing machine. The foregoing desired characteristics are provided by the unique container-mounted implement holder apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an implement holder apparatus that is used with a container which has top rim that has an outer rim diameter which has an exterior rim surface. The implement holder apparatus includes a base portion which has an inner base diameter which is greater than an outer rim diameter of a top rim of a container. The base portion has a open area which permits access to an interior of the container. A first implement retainer portion is connected to a top side of the base portion. In addition, a second implement retainer portion is connected to the top side of the base portion. The first implement retainer portion and the second implement retainer portion are on opposite locations on the base portion.

The base portion can be in a form of a ring, and the first implement retainer portion and the second implement retainer portion are located diametrically across from each other on the ring. The base portion includes a threaded interior surface.

In accordance with another embodiment of the invention, the base portion can include a first base subassembly, a second base subassembly adjustably connected to the first base subassembly, and a lock assembly for locking the first base subassembly and the second base subassembly in a selected adjustment connection. The first base subassembly and the second base subassembly are adjustable with respect to each other for adjusting the inner base diameter.

The first base subassembly includes a first container-engagement portion. A first implement retainer portion is connected to a top portion of the first container-engagement portion, and a first transverse portion connected to the top portion of the first container-engagement portion. The second base subassembly includes a second container-engagement portion, a second implement retainer portion connected to a top portion of the second container-engagement portion, and a second transverse portion connected to the top portion of the second container-engagement portion. The first transverse portion of the first base subassembly is in telescopic engagement with the second transverse portion of the second base subassembly. The lock assembly includes an internally threaded lock-screw-reception channel connected to the second transverse portion. A lock screw is received in the lock-screw-reception channel, and a lock handle is connected to the lock screw. Each of the first container-engagement portion and the second container-engagement portion includes a curved portion which includes internal threads.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved container-mounted implement holder apparatus which has all of the advantages of the prior art and none of the disadvantages.

It is another object of the present invention to provide a new and improved container-mounted implement holder apparatus which may be easily and efficiently manufactured and marketed.

It is a further object of the present invention to provide a new and improved container-mounted implement holder apparatus which is of durable and reliable construction.

An even further object of the present invention is to provide a new and improved container-mounted implement holder apparatus which is susceptible of a low cost of manufacture with regard to both materials and labor, and which accordingly is then susceptible of low prices of sale to the consuming public, thereby making such container-mounted implement holder apparatus available to the buying public.

Still yet a further object of the present invention is to provide a new and improved container-mounted implement holder apparatus which prevents a dispensing implement from sliding off of the top of an open container.

Still another object of the present invention is to provide a new and improved container-mounted implement holder apparatus that prevents a handle of a dispensing implement from contacting material contained within a container.

Yet another object of the present invention is to provide a new and improved container-mounted implement holder apparatus which does not employ a jaw portion that is internal to the container.

Even another object of the present invention is to provide a new and improved container-mounted implement holder apparatus that holds a dispensing implement for a container and does not take up table space in doing so.

Still a further object of the present invention is to provide a new and improved container-mounted implement holder apparatus which screws onto exterior threads at the top of a dispensing container.

Yet another object of the present invention is to provide a new and improved container-mounted implement holder apparatus that can be provided as a set of implement holders wherein each member of the set fits onto one size of a variety of sizes of jar tops.

Still another object of the present invention is to provide a new and improved container-mounted implement holder apparatus which can be provided as a single implement holder which is adjustable to fit onto a variety of sizes of jar tops.

Yet another object of the present invention is to provide a new and improved container-mounted implement holder apparatus that is safe for use in a dishwashing machine.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is a perspective view of a second embodiment of the invention which is adjustable for a variety of sizes of jar tops.

FIG. 6 is an enlarged cross-sectional view of the embodiment of the invention shown in FIG. 5 taken along line 6—6 thereof.

FIG. 7 is a perspective view of a third embodiment of the invention which is adjustable for a variety of sizes of jar tops.

FIG. 8 is a elevational view of the embodiment of the invention shown in FIG. 7.

DESCRIPTION OF THE PREFERRED EMBODIMENT

Figure 1:
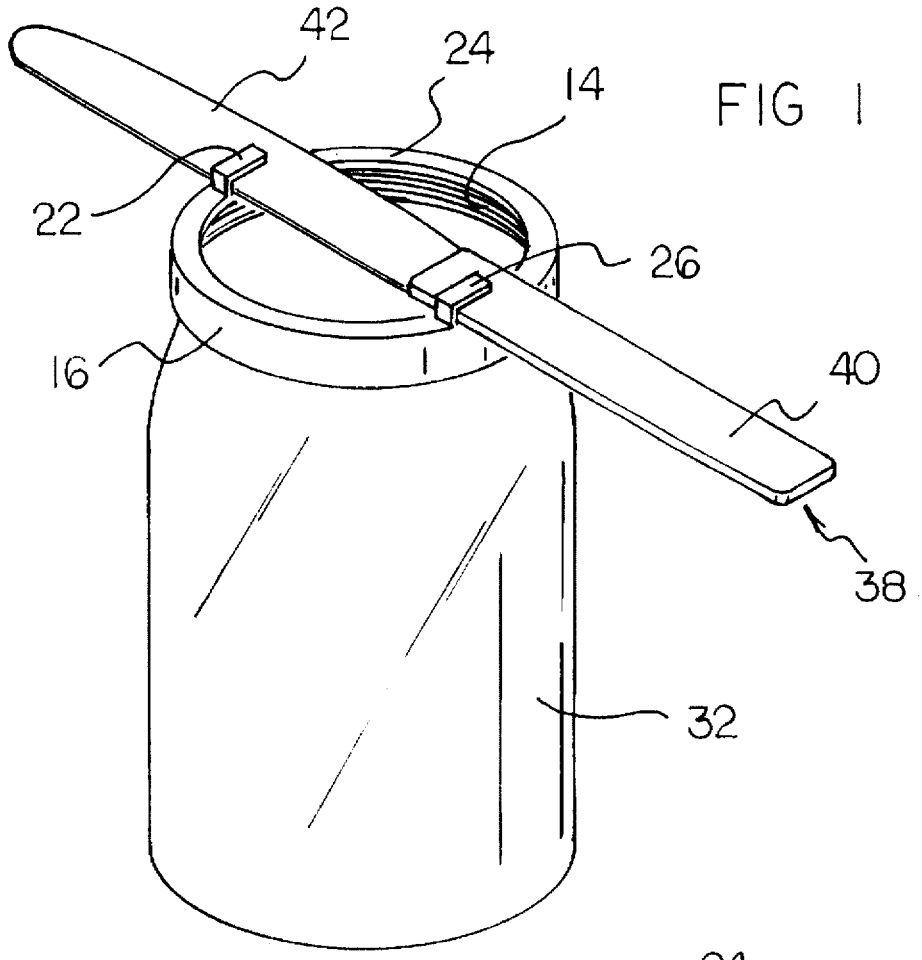
FIG. 1 is a perspective view showing a first embodiment of the container-mounted implement holder apparatus of the invention mounted on the open top of a screw top jar and retaining a knife.
Figure 2:
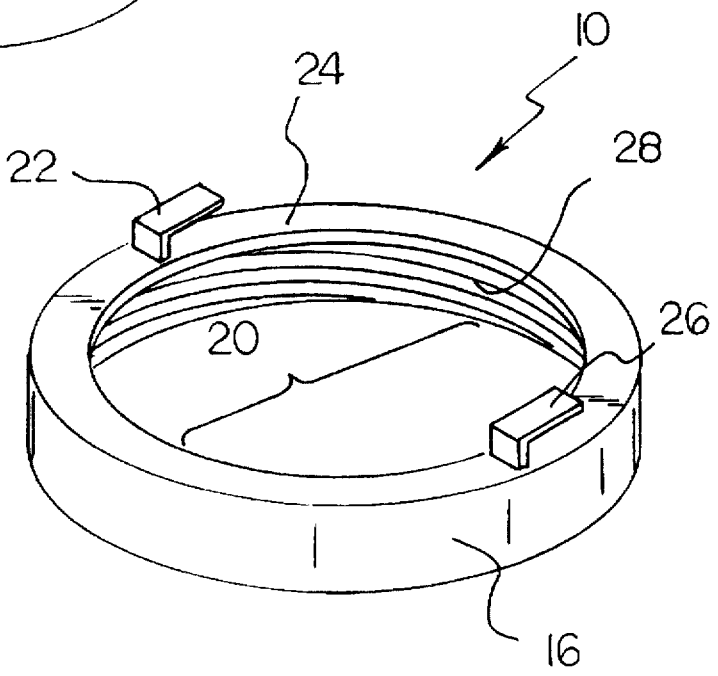
FIG. 2 is an enlarged perspective view of the embodiment of the container-mounted implement holder apparatus shown in FIG. 1 removed from the jar and not holding a dispensing implement.
Figure 3:
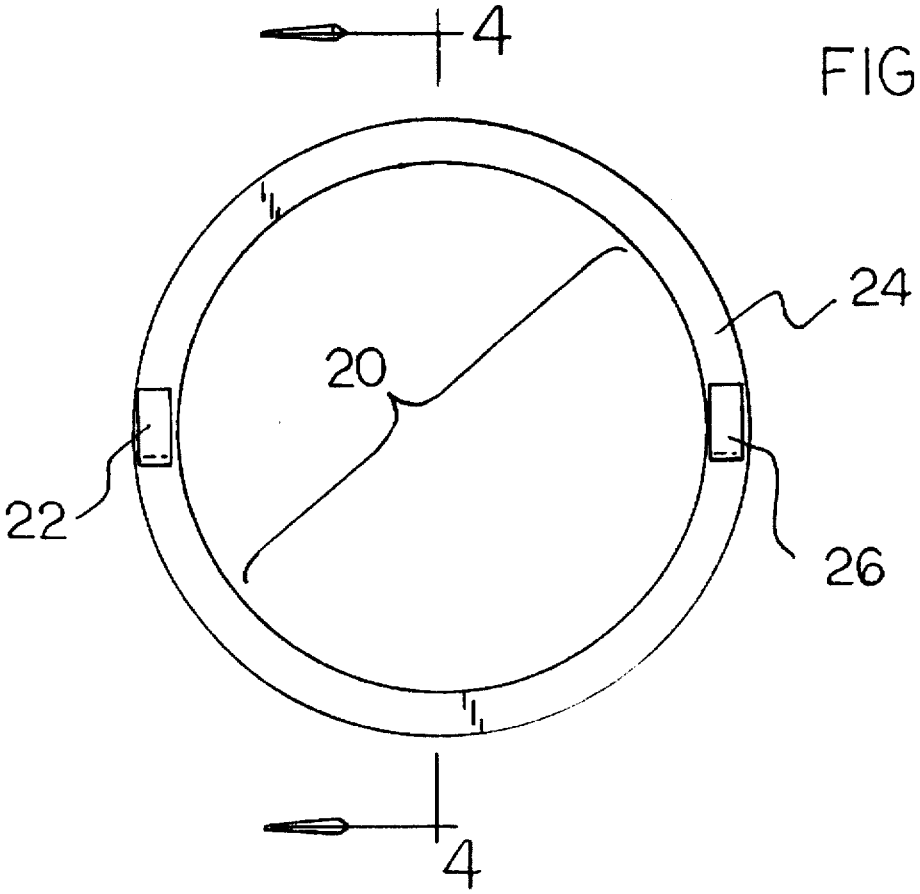
FIG. 3 is a top view of the embodiment of the container-mounted implement holder apparatus of FIG. 2.
Figure 4:
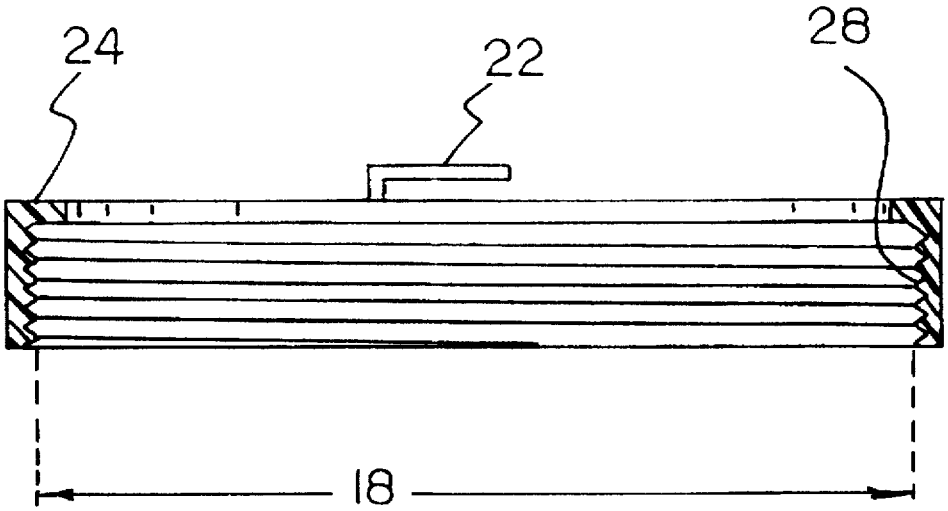
FIG. 4 is an enlarged cross-sectional view of the embodiment of the invention shown in FIG. 3 taken along line 4—4 thereof.

With reference to the drawings, a new and improved container-mounted implement holder apparatus embodying the principles and concepts of the present invention will be described.

Turning to FIGS. 1–4, there is shown a first embodiment of the container-mounted implement holder apparatus of the invention generally designated by reference numeral 10. In its preferred form, container-mounted implement holder apparatus 10 is used with a container which has top rim 14 that has an outer rim diameter which has an exterior rim surface. The implement holder apparatus 10 includes a base portion 16 which has an inner base diameter 18 which is greater than an outer rim diameter of a top rim 14 of a container. The base portion 16 has a open area 20 which permits access to an interior of the container. A first implement retainer portion 22 is connected to a top side 24 of the base portion 16. In addition, a second implement retainer portion 26 is connected to the top side 24 of the base portion 16. As shown in the drawings, the first implement retainer portion 22 and the second implement retainer portion 26 can be in the form of L-shaped retention brackets. The first implement retainer portion 22 and the second implement retainer portion 26 are on opposite locations on the base portion 16. The base portion 16 can be in a form of a ring, and the first implement retainer portion 22 and the second implement retainer portion 26 are located diametrically across from each other on the ring. The base portion 16 includes a threaded interior surface 28. The threaded interior surface 28 of the base portion 16 is complementary to a threaded exterior surface (not shown) of a top rim 14 of a jar 32.

With the first embodiment of the implement holder apparatus 10 of the invention, the implement holder apparatus 10 screws onto the top rim 14 of the jar 32. More specifically, in using the first embodiment of the implement holder apparatus 10 of the invention, a jar 32 is obtained that has a screw top (not shown). The screw top is unscrewed and removed from the jar 32. Then, the first embodiment of the implement holder apparatus 10 is installed onto the top rim 14 of the jar 32. This is done by screwing the threaded interior surface 28 of the base portion 16 onto the complementary threaded exterior surface of the top rim 14 of the jar 32. To remove a quantity of food product from the interior of the jar 32, a knife 38 can be used. When the knife 38 is used, the knife handle 40 is grasped, and the knife blade 42 is inserted through the open area 20 of the base portion 16 and into the interior of the jar 32. Food product can be lifted out from the jar 32 by the knife blade 42.

When the knife 38 is temporarily not used, the knife blade 42 can be slid under the first implement retainer portion 22, and the knife handle 40 can be slid under the second implement retainer portion 26, such as shown in FIG. 1. When this is done, the knife 38 is prevented from falling off of the jar 32, and the knife handle 40 is prevented from falling into the interior of the jar 32.

When the jar 32 is to be put away for storage, the knife 38 is removed from the implement holder apparatus 10 of the invention, the implement holder apparatus 10 is unscrewed from the top rim 14 of the jar 32, and the screw top (not shown) for the jar is screwed onto the threaded exterior surface of the top rim 14 of the jar 32. Then, the implement holder apparatus 10 of the invention can be cleaned, such as by hand or by placement in a dishwasher machine.

For a set of dispensing containers having different outer rim diameters, a set of first embodiments of the invention can be provided wherein each member of the set has an inner base diameter 18 that fits snugly on a corresponding dispensing container.

Turning to FIGS. 5 and 6, a second embodiment 13 of the implement holder apparatus of the invention is shown. Reference numerals are shown that correspond to like reference numerals that designate like elements shown in the other figures. In addition, the base portion 16 includes a first base subassembly 44, a second base subassembly 46 adjustably connected to the first base subassembly 44, and a lock assembly 45 for locking the first base subassembly 44 and the second base subassembly 46 in a selected adjustment connection. The first base subassembly 44 and the second base subassembly 46 are adjustable with respect to each other for adjusting the inner base diameter 18.

The first base subassembly 44 includes a first container-engagement portion 48. A first implement retainer portion 22 is connected to a top portion of the first container-engagement portion 48, and a first transverse portion 50 connected to the top portion of the first container-engagement portion 48. The second base subassembly 46 includes a second container-engagement portion 52, a second implement retainer portion 26 connected to a top portion of the second container-engagement portion 52, and a second transverse portion 54 connected to the top portion of the second container-engagement portion 52. The first transverse portion 50 of the first base subassembly 44 is in telescopic engagement with the second transverse portion 54 of the second base subassembly 46. The lock assembly 45 includes an internally threaded lock-screw-reception channel 47 connected to the second transverse portion 54. A lock screw 49 is received in the lock-screw-reception channel 47, and a lock handle 51 is connected to the lock screw 49. Each of the first container-engagement portion 48 and the second container-engagement portion 52 includes a curved portion which includes internal threads 56.

In using the second embodiment of the implement holder apparatus 13 of the invention, the lock handle 51 is rotated so that the lock screw 49 recedes from the lock-screw-reception channel 47, whereby the distal end of the lock screw 49 is not in engagement with the first transverse portion 50 of the first base subassembly 44. When this is done the first transverse portion 50 can be moved in and out of the second transverse portion 54 in order to increase or decrease the inner base diameter 18 as desired to accommodate different containers having different top rims with different outer rim diameters.

More specifically, the second embodiment of the implement holder apparatus 13 of the invention can be placed over an open jar 32. The first base subassembly 44 and the second base subassembly 46 can be pushed towards each other until the first container-engagement portion 48 and the second container-engagement portion 52 engage the top rim 14 of the jar 32. Then, the lock handle 51 can be rotated so that the lock screw 49 exerts a locking pressure on the first transverse portion 50 of the first base subassembly 44. In this way, the second embodiment of the invention is fixed to the jar 32. Then, a dispensing implement can be retained by the first implement retainer portion 22 and the second implement retainer portion 26. To remove the second embodiment of the invention from the jar 32, the lock handle 51 is rotated in the opposite direction, the lock screw 49 is withdrawn from contact with the first transverse portion 50, the first container-engagement portion 48 and the second container-engagement portion 52 are pulled slightly apart, and the implement holder apparatus 13 of the invention is lifted off of the jar 32.

Turning to FIGS. 7 and 8, a third embodiment 15 of the implement holder apparatus of the invention is shown. Reference numerals are shown that correspond to like reference numerals that designate like elements shown in the other figures. In addition, the base portion 16 includes a first base subassembly 64, a second base subassembly 66 adjustably connected to the first base subassembly 64. More specifically, first base subassembly includes a central semi-circular arcuate container engaging portion 68, and first and second opposed lateral portions 70 and 72. Similarly, second subassembly 66 comprises a central semi-circular portion 74 and first and second lateral portions 76 and 78.

A first adjustable fastener member in the form of a first threaded bolt 80 extends commonly through suitable apertures (unlabeled) in first lateral portion 70 of subassembly 64 and in first lateral potion 76 in second subassembly member 66, respectively. Similarly, a second adjustable fastener member in the form of a second threaded bolt 82 extends commonly through, suitable apertures (unlabeled) in second lateral portion 72 of subassembly 64 and in second lateral portion 78 of second subassembly member 66, respectively.

First bolt 80 is matingly engaged with a first adjustable (rotatable) nut 84 and has a first bolt head 86 affixed thereto at its opposite end for engaging lateral portion 76. Similarly, second bolt 82 is matingly engaged with a second adjustable (rotatable) nut 88 and has a second bolt head (unlabeled) affixed thereto at its opposite end for engaging lateral portion 78. Optionally, the nuts may be dispensed with in favor of threaded surfaces on the inside of the through apertures (unlabeled) in the first and second lateral portions 70, 72 of first base subassembly 64 as will occur to those of ordinary skill. In the latter case, adjustment is effected by rotating the bolt heads (e.g. bolt head 86) relative to the second base subassembly 66 in a suitable member.

As will be evident from the foregoing arrangement of parts, suitable rotation of nuts 84, 88 relative to bolts 80, 82, respectively, is effective to vary the distance 19 between and defined by subassemblies 64, 66 so that upon suitable adjustment of this dimension by manipulation of the adjustable first and second fastener members in the aforesaid manner, the implement holder 15 may be fitted to a wide range different containers having differing rim diameters, respectively. Hence, as in the embodiment of FIGS. 5 and 6, the third embodiment of the invention, shown in FIGS. 7 and 8 comprises a first base subassembly 64 and a second base subassembly 66 radially adjustable with respect to each other for adjusting the inner base diameter exemplified by dimension 19 (FIG. 8).

The first base subassembly 64 includes a first container-engagement portion (central arcuate portion 68). A first implement retainer portion 22 is connected to a top portion of the first container-engagement portion 68 whereas the second base subassembly 66 includes a second container-engagement portion (central arcuate portion 74) and second implement retainer portion 26 connected to a top portion of the second container-engagement portion 74.

Preferably, central arcuate portions 68 and 74 respectively have inwardly facing, circumferentially extending, confronting threaded surfaces 56 suitable for engaging the complimentary threaded surface of a container rim.

In use, the third embodiment of the implement holder apparatus 15 of the invention can be placed over an open jar 32. The first base subassembly 64 and the second base subassembly 66 can be adjusted relative to each other via adjustment of bolts 80, 82 and nuts 84, 86 until the inner surface of first container-engagement portion 68 and the second container-engagement portion 74 circumferentially engages the top rim 14 of the jar 32. Next, the nuts can be tightened sufficiently to enable the third embodiment of the invention to be fixed to the jar 32. Then, a dispensing implement can be retained by the first implement retainer portion 22 and the second implement retainer portion 26. To remove the second embodiment of the invention from the jar 32, the nuts 84 and 88 are loosened until the first container-engagement portion 68 and the second container-engagement portion 74 are pulled slightly apart whereby the implement holder apparatus 15 of the invention is easily lifted off of the jar 32.

It will be appreciated that any of the foregoing alternatively preferred embodiments of the invention can be used, if desired, separate from a dispensing container. When such a use is desired, the implement holder apparatus can be placed directly on a table top, and a dispensing implement can be supported by the implement holder apparatus.

The components of the container-mounted implement holder apparatus of the invention can be made from inexpensive and durable metal and plastic materials, especially materials safely washed in dishwasher machines.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved container-mounted implement holder apparatus that is low in cost, relatively simple in design and operation, and which may advantageously be used to prevent a dispensing implement from sliding off of the top of an open container. With the invention, a container-mounted implement holder apparatus is provided which prevents a handle of a dispensing implement contacting material contained within a container. With the invention, a container-mounted implement holder apparatus is provided which does not employ a jaw portion that is internal to the container. With the invention, a container-mounted implement holder apparatus is provided which holds a dispensing implement for a container and does not take up table space in doing so. With the invention, a container-mounted implement holder apparatus is provided which screws onto exterior threads at the top of a dispensing container. With the invention, a container-mounted implement holder apparatus is provided which can be provided as a set of implement holders wherein each member of the set fits onto one size of a variety of sizes of jar tops. With the invention, a container-mounted implement holder apparatus is provided which can be provided as a single implement holder which is adjustable to fit onto a variety of sizes of jar tops. With the invention, a container-mounted implement holder apparatus is provided which is safe for use in a dishwashing machine.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An implement holder apparatus for use with a container which has top rim which has an outer rim diameter which has an exterior rim surface, the implement holder apparatus comprising:

a base portion which has an inner base diameter which is greater than an outer rim diameter of a top rim of a container, wherein said base portion has an open area which permits access to an interior of the container, the base portion having a threaded interior surface;

a first implement retainer portion connected to a top side of said base portion, the first implement retainer portion extending orthogonally upward from the base portion;

a second implement retainer portion connected to a top side of said base portion, the second implement retainer portion extending orthogonally upward from the base portion, whereby an elongated utensil can be removably coupled with both the first and second implement retainer portions so as to extend over the open area of the base portion.

2. The apparatus of claim 1, wherein the first implement retainer portion and the second implement retainer portion are positioned on diametrically opposed sides of the base portion.

3. An implement holder apparatus comprising:

a container which has top rim which has an outer rim diameter which has an exterior rim surface;

a base portion which has an inner base diameter which is greater than an outer rim diameter of the top rim of the container, wherein said base portion has an open area which permits access to an interior of the container, the base portion having a threaded interior surface;

a first implement retainer portion connected to a top side of said base portion, the first implement retainer portion extending orthogonally upward from the base portion;

a second implement retainer portion connected to a top side of said base portion, the second implement retainer portion extending orthogonally upward from the base portion, whereby an elongated utensil can be removably coupled with both the first and second implement retainer portions so as to extend over the open area of the base portion.

4. The apparatus of claim 3, wherein the first implement retainer portion and the second implement retainer portion are positioned on diametrically opposed sides of the base portion.

* * * * *